US012806484B2

(12) United States Patent
Hong et al.

(10) Patent No.: US 12,806,484 B2
(45) Date of Patent: Nov. 24, 2026

(54) TUBULAR MEMBER AND TENNIS RACKET

(71) Applicant: SUREWIN WORLDWIDE LIMITED, Apia (WS)

(72) Inventors: Jin-San Hong, Taichung City (TW); Dennis Chen, Taichung City (TW)

(73) Assignee: SUREWIN WORLDWIDE LIMITED, Apia (WS)

( * ) Notice: Subject to any disclaimer, the term of this patent is extended or adjusted under 35 U.S.C. 154(b) by 277 days.

(21) Appl. No.: 18/737,655

(22) Filed: Jun. 7, 2024

(65) Prior Publication Data

US 2024/0416187 A1 Dec. 19, 2024

(30) Foreign Application Priority Data

Jun. 14, 2023 (TW) ..... 112122192

(51) Int. Cl.
*A63B 49/02* (2015.01)
*A63B 102/02* (2015.01)

(52) U.S. Cl.
CPC ..... *A63B 49/02* (2013.01); *A63B 2102/02* (2015.10)

(58) Field of Classification Search
CPC ..... A63B 49/02
See application file for complete search history.

(56) References Cited

U.S. PATENT DOCUMENTS 5,060,944 A * 10/1991 Janes ..... A63B 49/03 473/539
2018/0290027 A1* 10/2018 Yamanaka ..... A63B 49/02

FOREIGN PATENT DOCUMENTS

CN 107261438 A 10/2017

OTHER PUBLICATIONS

Search Report issued to European counterpart application No. 24181102.5 by the EPO on Oct. 22, 2024 (9 pages).

* cited by examiner

*Primary Examiner* — Yingchuan Zhang
(74) *Attorney, Agent, or Firm* — HSML P.C.

(57) ABSTRACT

A tubular member includes an inner frame portion, an outer frame portion, a wide portion, and a narrow portion. The inner frame portion includes a first inner frame section, a second inner frame section, and an inner connecting section. The outer frame portion includes a first outer frame section, a second outer frame section, and an outer connecting section. The wide portion extends straightly from the outer frame portion to the inner frame portion. The narrow portion interconnects the inner frame portion and the outer frame portion. The narrow portion is arc-shaped, and is spaced apart from the wide portion. A tennis racket includes a racket frame made by bending the tubular member as described previously to define a striking region, and the inner frame portion surrounds and is adjacent to the striking region.

7 Claims, 8 Drawing Sheets

TUBULAR MEMBER AND TENNIS RACKET

CROSS-REFERENCE TO RELATED APPLICATION

This application claims priority to Taiwanese Invention Patent Application No. 112122192, filed on Jun. 14, 2023, the entire disclosure of which is incorporated by reference herein.

FIELD

The disclosure relates to a tool for striking a ball, and more particularly to a tubular member and a tennis racket.

BACKGROUND

Referring to FIG. 1, a conventional racket includes a racket frame 3. The racket frame 3 includes a first side 31 and a second side 32 opposite to the first side 31. In a cross sectional view of the racket frame 3, the racket frame 3 is mirror symmetrical with respect to a radial line (A) between the first side 31 and the second side 32.

An air resistance experienced by a user when holding and swinging the racket forehand with the first side 31 facing a ball is the same as an air resistance experienced by the user when holding and swinging the racket backhand with the second side 32 facing the ball. Therefore, the racket does not fulfill requirements of a user who demands different swing experiences in forehand and backhand strokes. Furthermore, the racket is not adjustable for users of different ages to produce different swinging experiences.

SUMMARY

Therefore, an object of the disclosure is to provide a tubular member and a tennis racket that can alleviate at least one of the drawbacks of the prior art.

According to a first aspect of the disclosure, the tubular member is adapted for a partial structure of a piece of sports equipment used for striking a ball, and includes an inner frame portion, an outer frame portion, a wide portion, and a narrow portion.

The inner frame portion extends in a first axial direction, and includes a first inner frame section, a second inner frame section, and an inner connecting section that interconnects the first inner frame section and the second inner frame section.

The outer frame portion extends in the first axial direction and is spaced apart from the inner frame portion in a second axial direction that is perpendicular to the first axial direction. The outer frame portion includes a first outer frame section, a second outer frame section, and an outer connecting section that interconnects the first outer frame section and the second outer frame section.

The wide portion extends in the first axial direction, and extends straightly from the outer frame portion to the inner frame portion in the second axial direction.

The narrow portion extends in the first axial direction and interconnects the inner frame portion and the outer frame portion. The narrow portion is arc-shaped, and is spaced apart from the wide portion in a third axial direction that is perpendicular to the first axial directions and the second axial direction. A length of the wide portion in the second axial direction is equal to a first width. A length of the narrow portion in the second axial direction is equal to a second width. The second width is smaller than the first width. The first inner frame section has a first inner side end that is connected to the wide portion, and a first inner connecting end that is opposite to the first inner side end. The second inner frame section has a second inner side end that is connected to the narrow portion, and a second inner connecting end that is opposite to the second inner side end. The inner connecting section interconnects the first inner connecting end and the second inner connecting end. The first outer frame section has a first outer side end that is connected to the wide portion, and a first outer connecting end that is opposite to the first outer side end. The second outer frame section has a second outer side end that is connected to the narrow portion, and a second outer connecting end that is opposite to the second outer side end. The outer connecting section interconnects the first outer connecting ends and the second outer connecting end. A plane that is perpendicular to the second axial direction and that passes through the wide portion and the narrow portion is defined as a reference plane. Starting from the first inner side end, the first inner frame section extends gradually away from the reference plane to the first inner connecting end. Starting from the second inner connecting end, the second inner frame section gradually approaches the reference plane to reach at the narrow portion. Starting from the first outer side end, the first outer frame section extends gradually away from the reference plane to the first outer connecting end. Starting from the second outer connecting end, the second outer frame section gradually approaches the reference plane to reach at the narrow portion. A maximum distance between an edge of the inner connecting section distal from the outer connecting section and an edge of the outer connecting section distal from the inner connecting section in the second axial direction is equal to a third width. A ratio of the third width to the first width is 11:9. Each of a radius of curvature of a portion of the first inner frame section that is adjacent to the wide portion and a radius of curvature of a portion of the first outer frame section that is adjacent to the wide portion ranges from 71 millimeters to 86 millimeters. Each of a radius of curvature of a portion of the second inner frame section that is adjacent to the narrow portion and a radius of curvature of a portion of the second outer frame section that is adjacent to the narrow portion ranges from 20 millimeters to 25 millimeters. A length of the tubular member in the third axial direction is equal to a section length. A ratio of the section length to the first width is 25:9. A radius of curvature of the narrow portion ranges from 2.7 millimeters to 3.3 millimeters.

According to a second aspect of the disclosure, a tennis racket includes a racket frame made by bending the tubular member as described previously to define a striking region, and the inner frame portion surrounds and is adjacent to the striking region.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
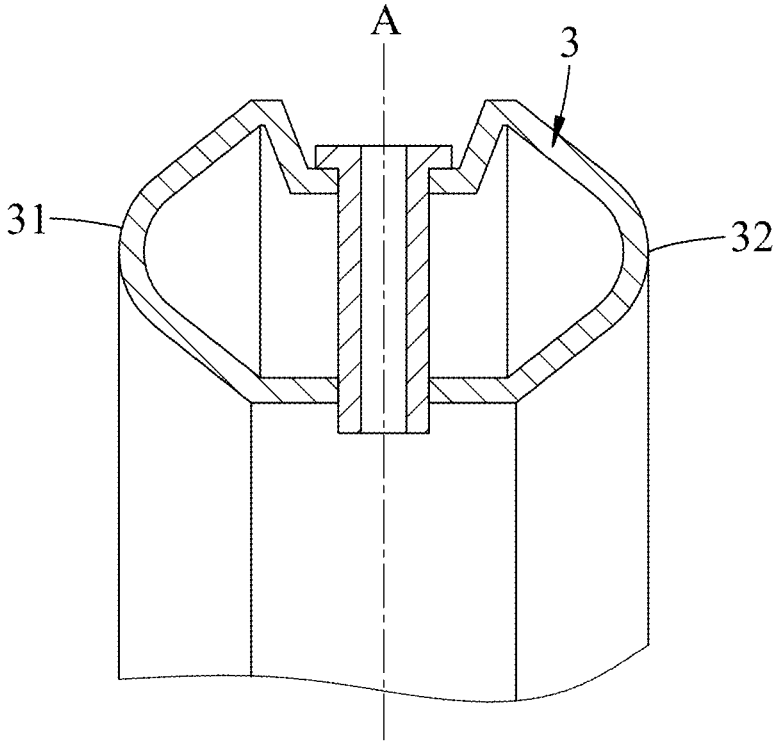
FIG. 1 PRIOR ART
FIG. 1 is a schematic fragmentary cross-sectional view of a racket frame of a conventional racket.

Before the disclosure is described in greater detail, it should be noted that where considered appropriate, reference numerals or terminal portions of reference numerals have been repeated among the figures to indicate corresponding or analogous elements, which may optionally have similar characteristics. It should be noted that, in this disclosure, a first axial direction (D1), a second axial direction (D2), and a third axial direction (D3) are perpendicular to each other.

Figure 2:
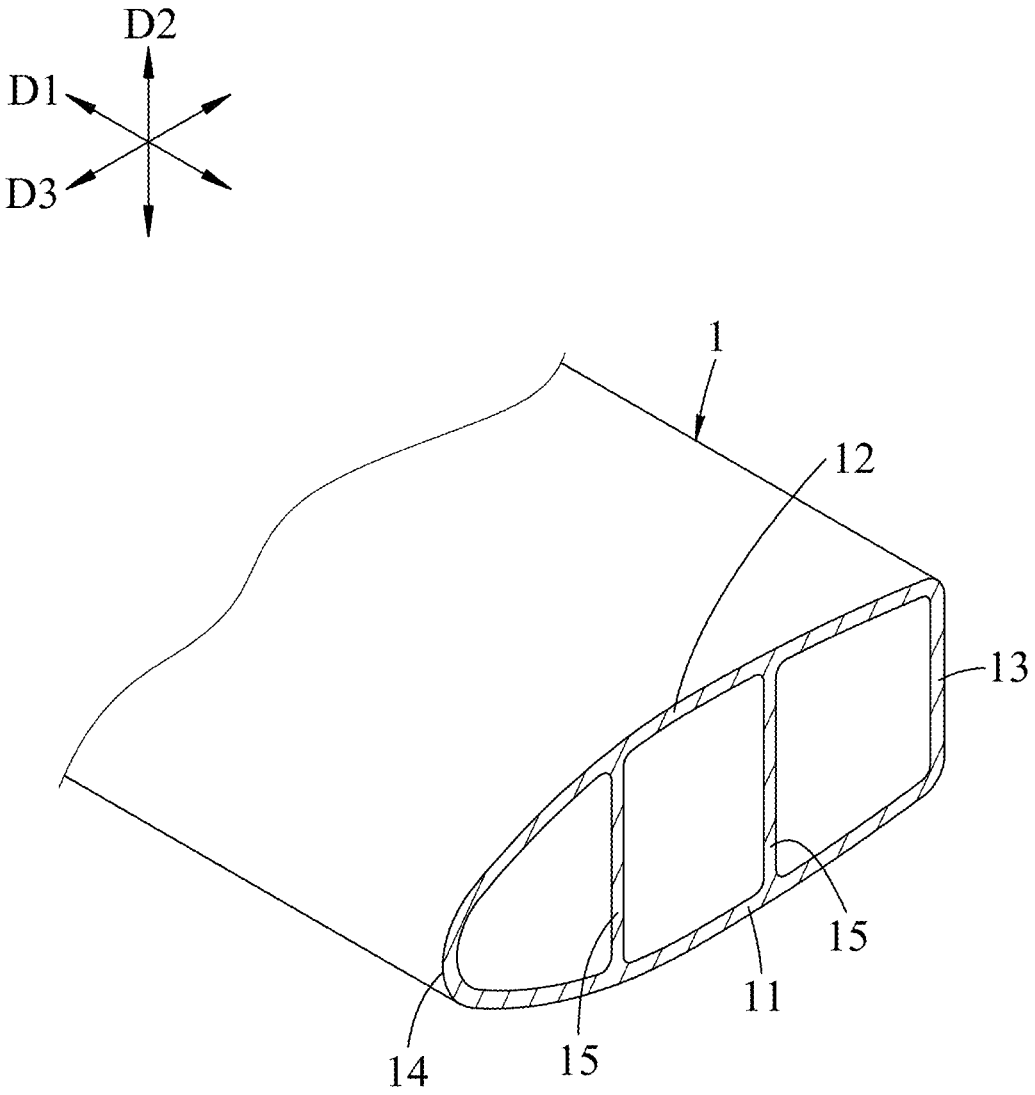
FIG. 2 is a fragmentary perspective cross-sectional view of a first embodiment of a tubular member according to the disclosure.
Figure 3:
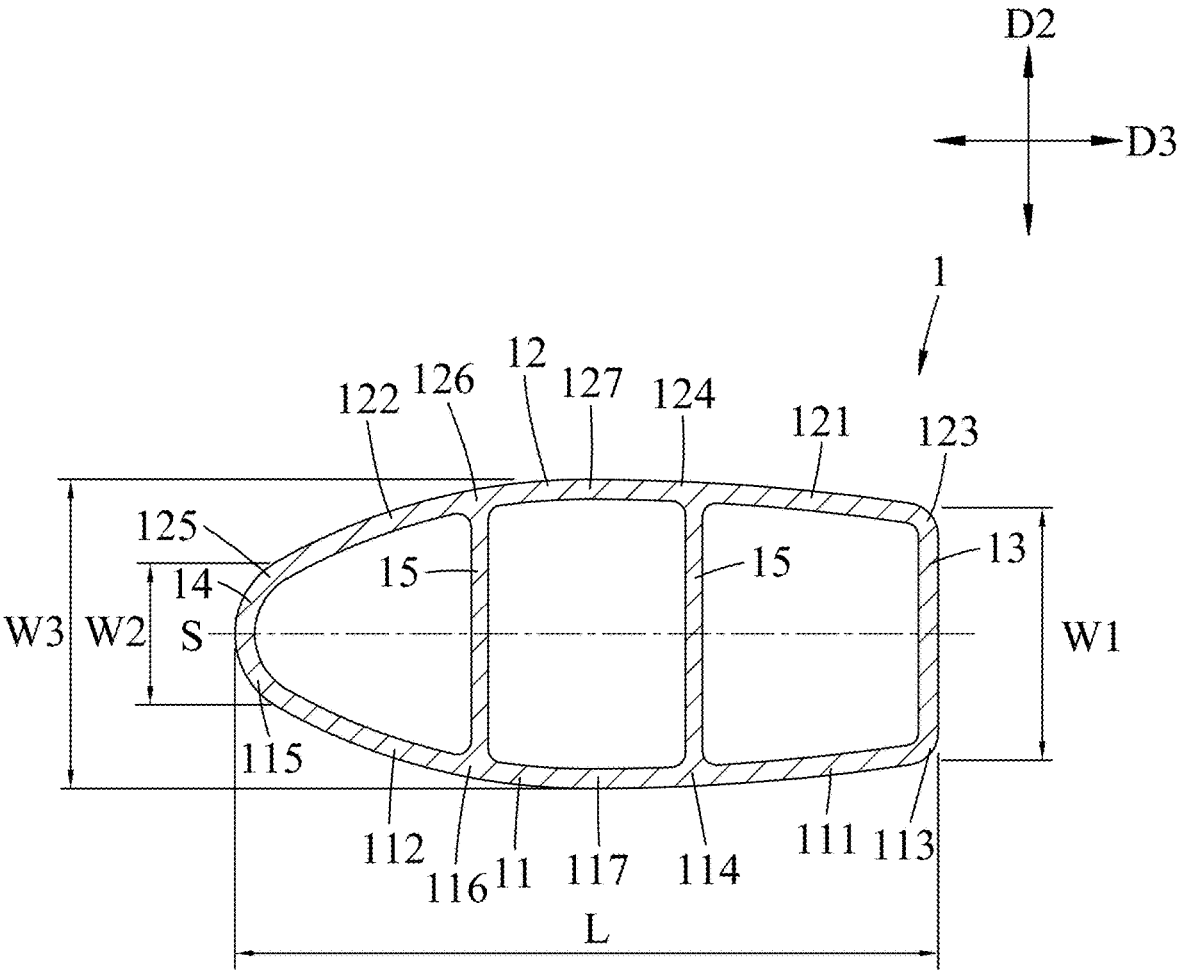
FIG. 3 is a cross-sectional view of the first embodiment of the tubular member according to the disclosure.

Referring to FIGS. 2 and 3, a first embodiment of a tubular member 1 according to the disclosure is adapted for a partial structure of a piece of sports equipment used for striking a ball, for example, a racket frame, a racket handle, or a hockey stick. The tubular member 1 includes an inner frame portion 11 extending in the first axial direction (D1), an outer frame portion 12 extending in the first axial direction (D1) and spaced apart from the inner frame portion 11 in the second axial direction (D2), a wide portion 13 extending in the first axial direction (D1) and extending straightly from the outer frame portion 12 to the inner frame portion 11 in the second axial direction (D2), a narrow portion 14 extending in the first axial direction (D1) and interconnecting the inner frame portion 11 and the outer frame portion 12, and two rib frame portions 15 disposed between the narrow portion 14 and the wide portion 13. In this embodiment, the tubular member 1 is made of an aluminum alloy by extrusion or a carbon aluminum composite material, but is not limited thereto.

The inner frame portion 11 includes a first inner frame section 111, a second inner frame section 112, and an inner connecting section 117 that interconnects the first inner frame section 111 and the second inner frame section 112. The first inner frame section 111 has a first inner side end 113 that is connected to the wide portion 13, and a first inner connecting end 114 that is opposite to the first inner side end 113. The second inner frame section 112 has a second inner side end 115 that is connected to the narrow portion 14, and a second inner connecting end 116 that is opposite to the second inner side end 115. The inner connecting section 117 interconnects the first inner connecting end 114 and the second inner connecting end 116.

The outer frame portion 12 includes a first outer frame section 121, a second outer frame section 122, and an outer connecting section 127 that interconnects the first outer frame section 121 and the second outer frame section 122. The first outer frame section 121 has a first outer side end 123 that is connected to the wide portion 13, and a first outer connecting end 124 that is opposite to the first outer side end 123. The second outer frame section 122 has a second outer side end 125 that is connected to the narrow portion 14, and a second outer connecting end 126 that is opposite to the second outer side end 125. The outer connecting section 127 interconnects the first outer connecting end 124 and the second outer connecting end 126.

The wide portion 13 extends straightly in the second axial direction (D2) from the first outer side end 123 of the first outer frame section 121 to the first inner side end 113 of the first inner frame section 111.

The narrow portion 14 is arc-shaped and interconnects the second inner side end 115 of the second inner frame section 112 and the second outer side end 125 of the second outer frame section 122. The narrow portion 14 is spaced apart from the wide portion 13 in the third axial direction (D3).

A plane that is perpendicular to the second axial direction (D2) and that passes through the wide portion 13 and the narrow portion 14 is defined as a reference plane (S). Starting from the first inner side end 113, the first inner frame section 111 extends gradually away from the reference plane (S) to the first inner connecting end 114. Starting from the second inner connecting end 116, the second inner frame section 112 gradually approaches the reference plane (S) to reach at the narrow portion 14. Starting from the first outer side end 123, the first outer frame section 121 extends gradually away from the reference plane (S) to the first outer connecting end 124. Starting from the second outer connecting end 126, the second outer frame section 122 gradually approaches the reference plane (S) to reach at the narrow portion 14. In a cross-sectional view perpendicular to the first axial direction (D1), the inner frame portion 11 and the outer frame portion 12 may be mirror-symmetrical with respect to the reference plane (S) and smoothly streamlined.

Detailed descriptions regarding the dimensions of the tubular member 1 are described further below.

Each of a radius of curvature of a portion of the first inner frame section 111 that is adjacent to the wide portion 13 and a radius of curvature of a portion of the first outer frame section 121 that is adjacent to the wide portion 13 ranges from 71 millimeters (mm) to 86 mm. Each of a radius of curvature of a portion of the second inner frame section 112 that is adjacent to the narrow portion 14 and a radius of curvature of a portion of the second outer frame section 122 that is adjacent to the narrow portion 14 ranges from 20 mm to 25 mm. A radius of curvature of the narrow portion 14 ranges from 2.7 mm to 3.3 mm.

Specifically, in this embodiment, each of the radius of curvature of the portion of the first inner frame section 111 that is adjacent to the wide portion 13 and the radius of curvature of the portion of the first outer frame section 121 that is adjacent to the wide portion 13 is 78.625 mm. Each of the radius of curvature of the portion of the second inner frame section 112 that is adjacent to the narrow portion 14 and the radius of curvature of the portion of the second outer frame section 122 that is adjacent to the narrow portion 14 is 22.3 mm. The radius of curvature of the narrow portion 14 is 3 mm.

A length of the wide portion 13 in the second axial direction (D2) is equal to a first width (W1), and a length of the narrow portion 14 in the second axial direction (D2) is equal to a second width (W2). A maximum distance between an edge of the inner connecting section 117 distal from the outer connecting section 127 and an edge of the outer connecting section 127 distal from the inner connecting section 117 in the second axial direction (D2) is equal to a third width (W3), which is substantially the same as a maximum width of the tubular member 1 in the second axial direction (D2). A ratio of the third width (W3) to the first width (W1) is 11:9. The length of the wide portion 13 in the second axial direction (D2) (i.e., the first width (W1)) is greater than the length of the narrow portion 14 in the second axial direction (D2) (i.e., the second width (W2)) and smaller than the maximum width of the tubular member 1 in the second axial direction (D2) (i.e., the third width (W3)). A length of the tubular member 1 in the third axial direction (D3) is equal to a section length (L), and a ratio of the section length (L) to the first width (W1) is 25:9.

The rib frame portions 15 are spaced apart from each other in the third axial direction (D3), and interconnect the inner frame portion 11 and the outer frame portion 12. The rib frame portions 15 may enhance rigidity and strength of the tubular member 1.

Overall, in the cross-sectional view perpendicular to the first axial direction (D1), an outer contour of the tubular member 1 is streamlined and bullet-shaped. A shape of the tubular member 1 proximate to the wide portion 13 is similar to a base of a bullet, and a shape of the tubular member 1 proximate to the narrow portion 14 is similar to a head of the bullet.

Figure 4:
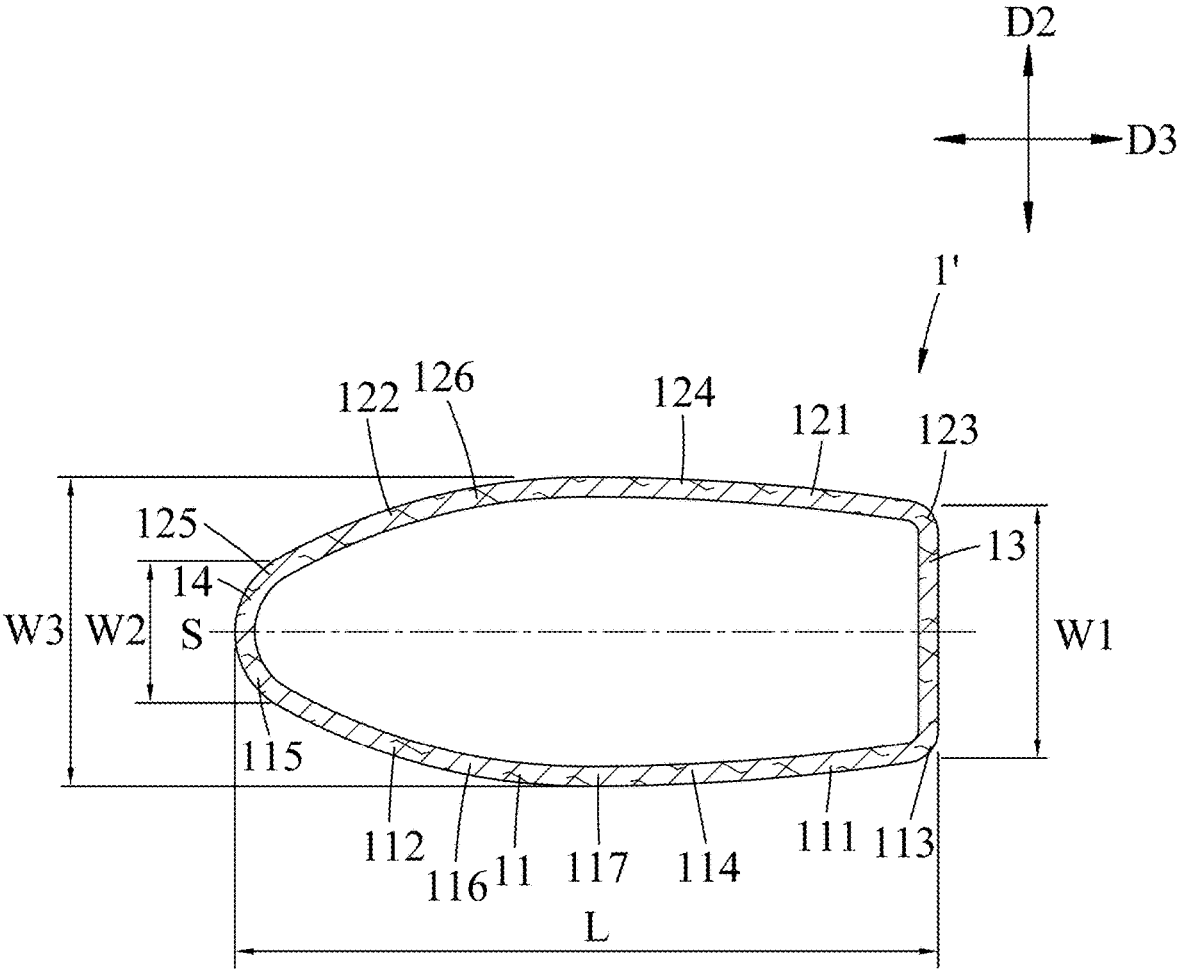
FIG. 4 is a cross-sectional view of a second embodiment of the tubular member according to the disclosure.

Referring to FIG. 4, a second embodiment of the tubular member 1' of the disclosure is similar to its first embodiment, and the difference therebetween resides in that the second embodiment of the tubular member 1' is formed by hot pressing of a carbon fiber composite material, and that the second embodiment of the tubular member 1' does not include the rib frame portions 15 (see FIG. 3) as in the first embodiment and is hollow.

Figure 5:
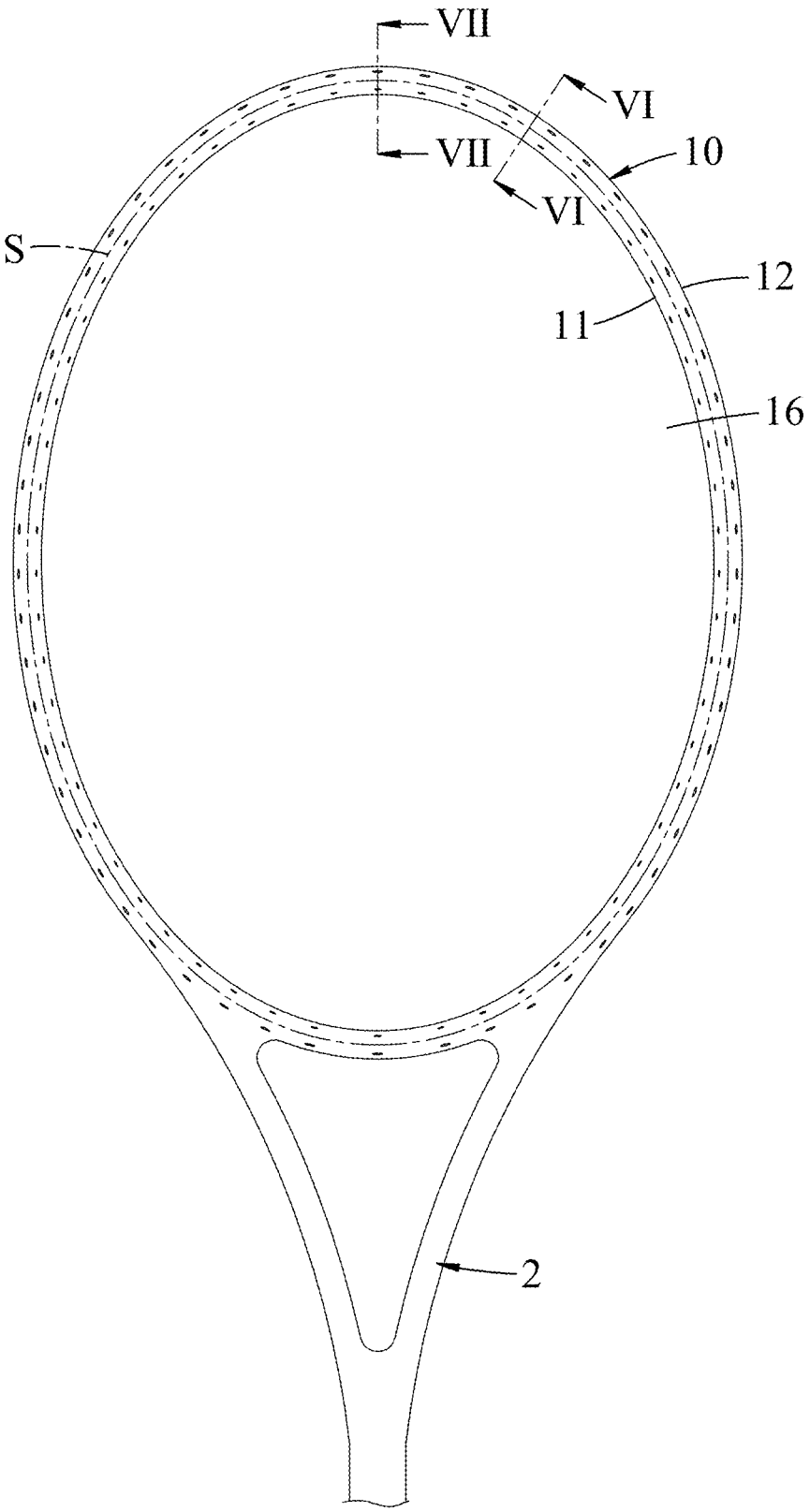
FIG. 5 is a fragmentary side view of a first embodiment of a tennis racket according to the disclosure.

Referring to FIG. 5, a first embodiment of a tennis racket of this disclosure is adapted to be connected a handle grip (not shown) and for threading of a plurality of strings (not shown). The tennis racket includes a racket frame 10 and a racket handle 2 connected to the racket frame 10. The racket frame 10 is made by bending the first embodiment of the tubular member 1 to surround and define a striking region 16. The inner frame portion 11 of the tubular member 1 surrounds and is adjacent to the striking region 16.

Figure 6:
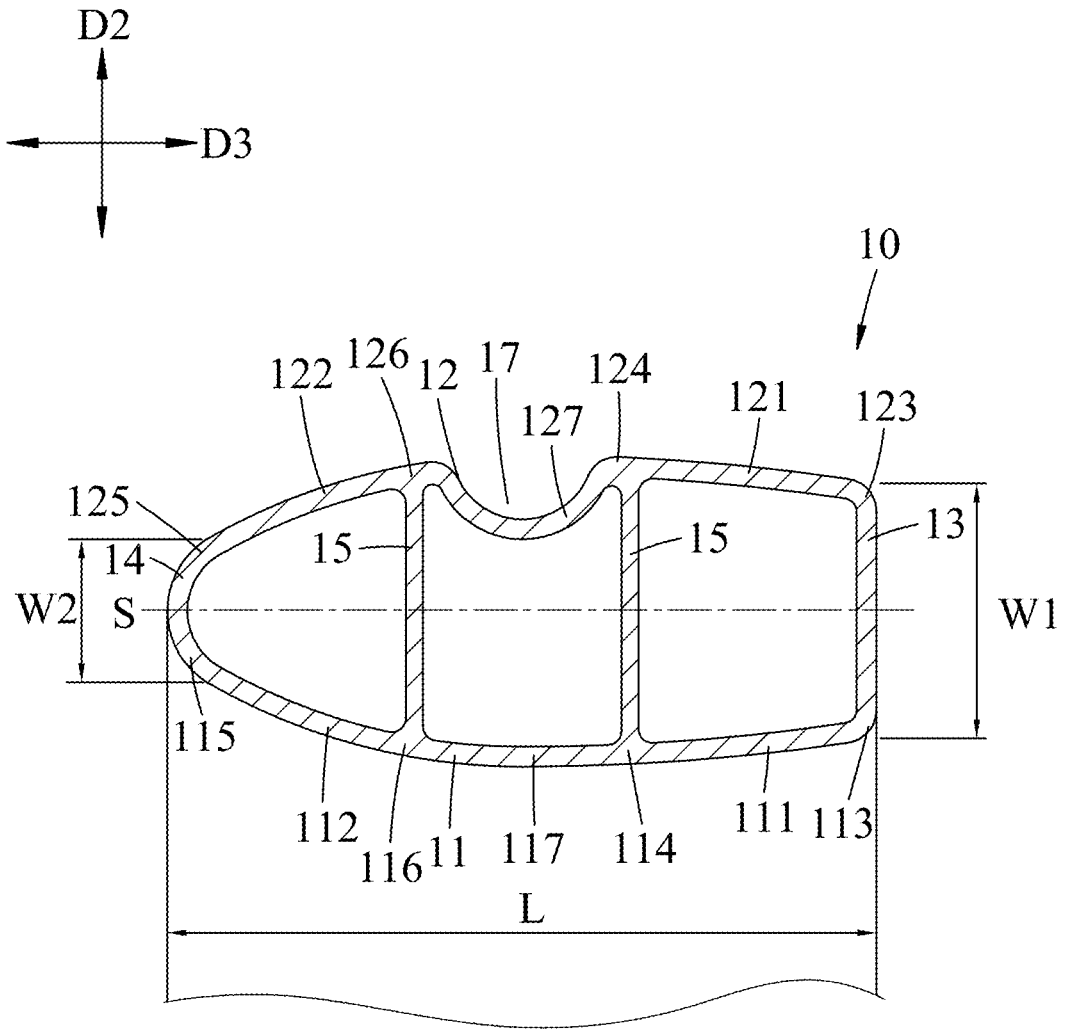
FIG. 6 is a fragmentary cross-sectional view of the first embodiment of the tennis racket taken along line VI-VI in FIG. 5.
Figure 7:
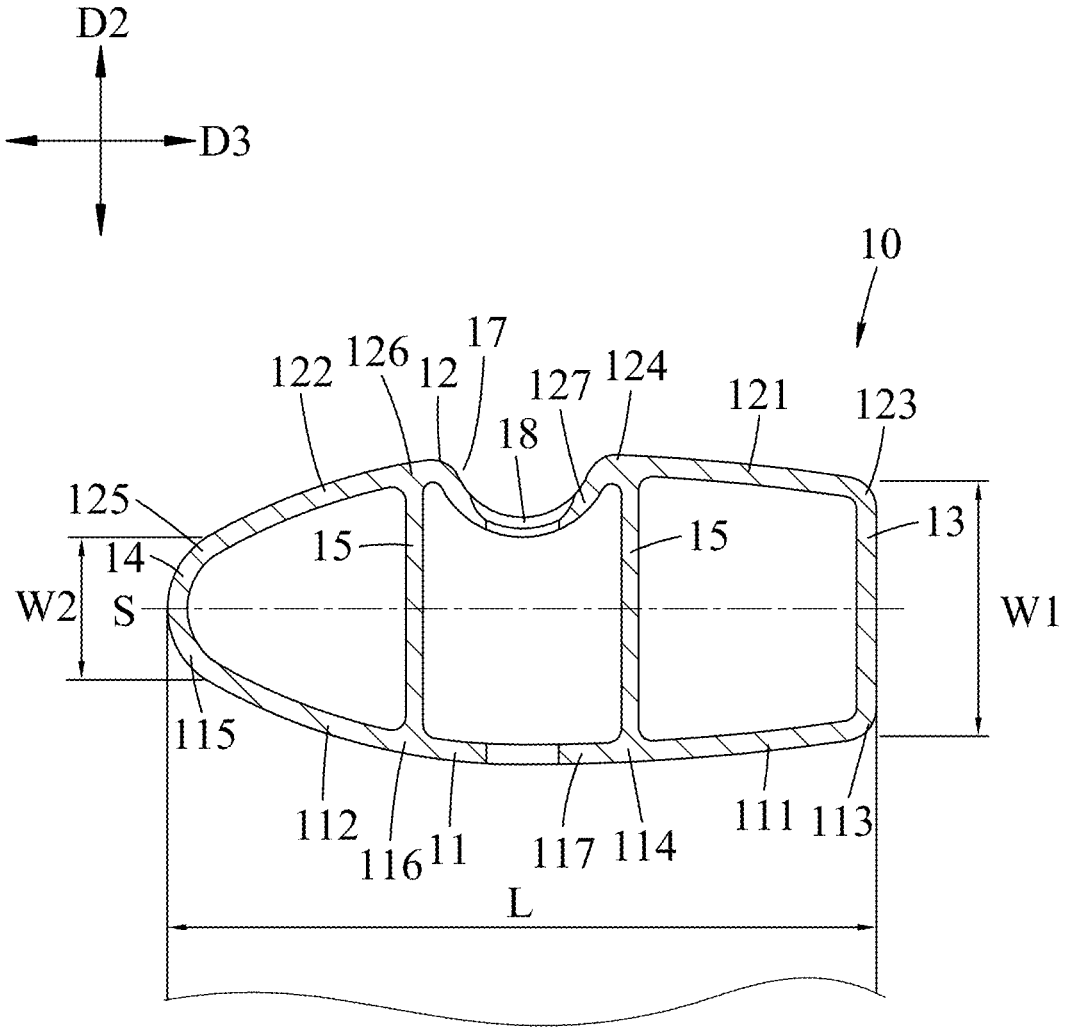
FIG. 7 is a fragmentary cross-sectional view of the first embodiment of the tennis racket taken along line VII-VII in FIG. 5.

Referring to FIGS. 6 and 7, the outer connecting section 127 of the outer frame portion 12 is rolled to form an avoidance groove 17 surrounding the striking region 16. The tennis racket has a plurality of string holes 18 formed in a groove-defining surface that defines the avoidance groove 17 of the outer frame portion 12 and extending through the inner frame portion 11. The string holes 18 are configured for the strings to be passed therethrough.

In this embodiment, stiffness (Rahmen, RA) of the tennis racket at the narrow portion 14 is 80, and stiffness at the wide portion 13 is 83. The aforementioned stiffness was measured by using a RDC (Racquet Diagnostic Center) instrument (not shown) manufactured by Babolat. When measuring, the tennis racket is first placed horizontally on a platform (not shown) of the RDC instrument with the handle grip fixed to the platform, and a force member (not shown) applies pressure to the narrow portion 14 or the wide portion 13 to obtain stiffness of the tennis racket through the pressure exerted by the force member.

The effect of using the tennis racket of this disclosure is described as follows. When swinging the tennis racket with the wide portion 13 facing a ball, air resistance is greater and it takes more energy to swing the tennis racket. When swinging the tennis racket with the narrow portion 14 facing the ball, the air resistance is smaller and it takes less energy to swing the tennis racket. That is to say, air resistance in forehand swing and backhand swing are different. Therefore, in this disclosure, by virtue of holding and swinging the tennis racket with the wide portion 13 or the narrow portion 14 facing the ball, different swinging experiences are produced.

For example, when a user is under a lower training load during practices, the user may choose to swing the tennis racket with the narrow portion 14 facing the ball. When the user is to increase the training load, the user may conveniently switch to swing the tennis racket with the wide portion 13 facing the ball. For players of different ages and genders, due to arm strength of each of the players being different, players having smaller arm strength may swing the tennis racket with the narrow portion 14 facing the ball, and players having bigger arm strength may swing the tennis racket with the wide portion 13 facing the ball. Therefore, a single racket may satisfy different needs of the players.

Figure 8:
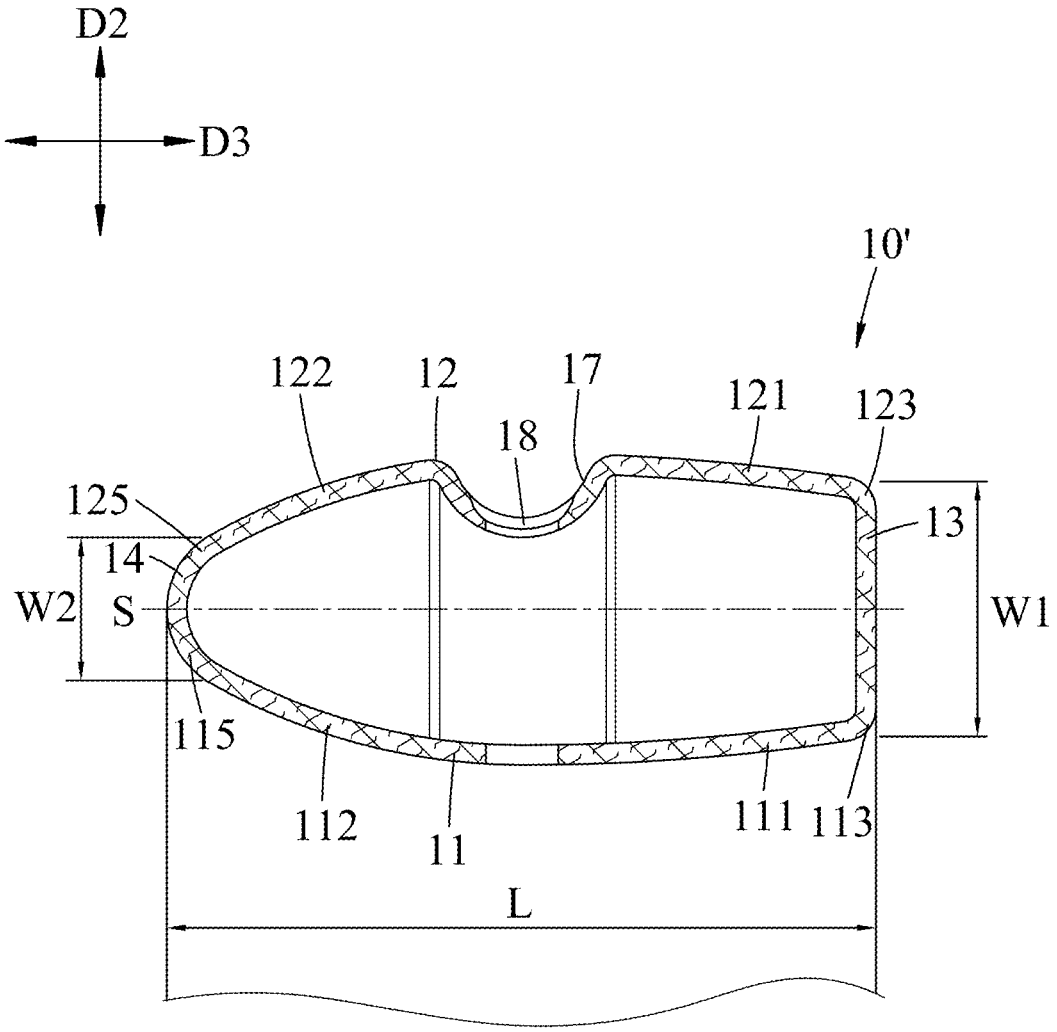
FIG. 8 is a fragmentary cross-sectional view of a second embodiment of the tennis racket according to the disclosure.

Referring to FIG. 8, a second embodiment of the tennis racket of this disclosure is similar to the first embodiment, but differs from it such that the racket frame 10' is made by bending the second embodiment of the tubular member 1'. Since a shape of an outer contour of a cross section of the racket frame 10' is the same as that of the racket frame 10 (see FIG. 6) of the first embodiment, the racket frame 10' may likewise produce the same effect as its first embodiment when being swung in different directions.

In conclusion, by virtue of the tennis racket of this disclosure being straight at the wide portion 13, and the length of the wide portion 13 in the second axial direction (D2) being greater than the length of the narrow portion 14 in the second axial direction (D2), when swinging the tennis racket with the wide portion 13 or the narrow portion 14 facing the ball, the user experiences different air resistances. The user may choose to hold the tennis racket differently according to requirements so as to produce different swinging experiences, so the object of this disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A tubular member adapted for a partial structure of a piece of sports equipment used for striking a ball, comprising:

an inner frame portion extending in a first axial direction, said inner frame portion including a first inner frame section, a second inner frame section, and an inner connecting section that interconnects said first inner frame section and said second inner frame section;

an outer frame portion extending in said first axial direction and spaced apart from said inner frame portion in a second axial direction that is perpendicular to said first axial direction, said outer frame portion including a first outer frame section, a second outer frame section, and an outer connecting section that interconnects said first outer frame section and said second outer frame section;

a wide portion extending in said first axial direction and extending straightly from said outer frame portion to said inner frame portion in said second axial direction, said wide portion being straight; and a narrow portion extending in said first axial direction and interconnecting said inner frame portion and said outer frame portion, said narrow portion being arc-shaped and spaced apart from said wide portion in a third axial direction that is perpendicular to said first axial directions and said second axial direction, a length of said wide portion in said second axial direction being equal to a first width, a length of said narrow portion in said second axial direction being equal to a second width, said second width being smaller than said first width, said first inner frame section having a first inner side end that is connected to said wide portion and a first inner connecting end that is opposite to said first inner side end, said second inner frame section having a second inner side end that is connected to said narrow portion and a second inner connecting end that is opposite to said second inner side end, said inner connecting section interconnecting said first inner connecting end and said second inner connecting end, said first outer frame section having a first outer side end that is connected to said wide portion and a first outer connecting end that is opposite to said first outer side end, said second outer frame section having a second outer side end that is connected to said narrow portion and a second outer connecting end that is opposite to said second outer side end, said outer connecting section interconnecting said first outer connecting ends and said second outer connecting end, a plane that is perpendicular to said second axial direction and that passes through said wide portion and said narrow portion being defined as a reference plane, starting from said first inner side end, said first inner frame section extending gradually away from said reference plane to said first inner connecting end, starting from said second inner connecting end, said second inner frame section gradually approaching said reference plane to reach at said narrow portion, starting from said first outer side end, said first outer frame section extending gradually away from said reference plane to said first outer connecting end, starting from said second outer connecting end, said second outer frame section gradually approaching said reference plane to reach at said narrow portion, a maximum distance between an edge of said inner connecting section distal from said outer connecting section and an edge of said outer connecting section distal from said inner connecting section in said second axial direction being equal to a third width, a ratio of said third width to said first width being 11:9, each of a radius of curvature of a portion of said first inner frame section that is adjacent to said wide portion and a radius of curvature of a portion of said first outer frame section that is adjacent to said wide portion ranging from 71 millimeters to 86 millimeters, each of a radius of curvature of a portion of said second inner frame section that is adjacent to said narrow portion and a radius of curvature of a portion of said second outer frame section that is adjacent to said narrow portion ranging from 20 millimeters to 25 millimeters, a length of said tubular member in said third axial direction being equal to a section length, a ratio of said section length to said first width being 25:9, a radius of curvature of said narrow portion ranging from 2.7 millimeters to 3.3 millimeters.

2. The tubular member as claimed in claim 1, wherein, in a cross-sectional view perpendicular to said first axial direction, said inner frame portion and said outer frame portion are mirror-symmetrical with respect to said reference plane and are smoothly streamlined.

3. The tubular member as claimed in claim 1, further comprising two rib frame portions disposed between said narrow portion and said wide portion and being spaced apart from each other in said third axial direction, each of said rib frame portions interconnecting said inner frame portion and said outer frame portion.

4. A tennis racket, comprising:

a racket frame made by bending said tubular member as claimed in claim 1 to define a striking region, said inner frame portion surrounding and being adjacent to said striking region.

5. The tennis racket as claimed in claim 4, wherein said outer frame portion forms an avoidance groove surrounding said striking region, said tennis racket further comprising a plurality of string holes that are formed in a groove-defining surface defining said avoidance groove and that extend through said inner frame portion.

6. The tubular member as claimed in claim 1, wherein a stiffness at the narrow portion is less than a stiffness at the wide portion.

7. The tubular member as claimed in claim 6, wherein the stiffness at the narrow portion is 80, and the stiffness at the wide portion is 83.

* * * * *